US007621059B2

(12) United States Patent
McCoy, Jr. et al.

(10) Patent No.: US 7,621,059 B2
(45) Date of Patent: Nov. 24, 2009

(54) UNDERWATER SEDIMENT EVACUATION SYSTEM

(75) Inventors: Richard W. McCoy, Jr., Cypress, TX (US); F. Richard Frisbie, San Francisco, CA (US)

(73) Assignee: Oceaneering International, Inc., Houston, TX (US)

( * ) Notice: Subject to any disclaimer, the term of this patent is extended or adjusted under 35 U.S.C. 154(b) by 69 days.

(21) Appl. No.: 11/874,691

(22) Filed: Oct. 18, 2007

(65) Prior Publication Data

US 2009/0100724 A1 Apr. 23, 2009

(51) Int. Cl.
*E02F 3/88* (2006.01)
*B63C 7/22* (2006.01)

(52) U.S. Cl. ..... 37/317; 37/311; 405/228; 114/296

(58) Field of Classification Search ..... 405/224, 405/224.1, 277, 228
See application file for complete search history.

(56) References Cited

U.S. PATENT DOCUMENTS

| | | | | | |
|---|---|---|---|---|---|
| 861,745 | A | * | 7/1907 | Maxwell | 37/323 |
| 1,120,980 | A | * | 12/1914 | Schofield | 56/32 |
| 1,326,321 | A | * | 12/1919 | Callahan | 37/323 |
| 1,808,066 | A | * | 6/1931 | Plummer | 37/336 |
| 2,926,437 | A | * | 3/1960 | Ellicott, Jr. | 37/336 |
| 3,248,812 | A | * | 5/1966 | Gardner | 37/314 |
| 3,323,646 | A | | 6/1967 | Humphreys | |
| 3,411,473 | A | * | 11/1968 | Mott et al. | 114/296 |
| 3,431,879 | A | * | 3/1969 | Westling | 114/294 |
| 3,456,371 | A | * | 7/1969 | Mabson et al. | 37/195 |
| 3,495,409 | A | * | 2/1970 | Riedemann | 405/286 |
| 3,496,900 | A | * | 2/1970 | Mott et al. | 114/296 |
| 3,681,862 | A | * | 8/1972 | De Koning et al. | 37/317 |
| 3,817,040 | A | * | 6/1974 | Stevens | 405/228 |
| 3,965,687 | A | * | 6/1976 | Shaw | 405/226 |
| 4,069,681 | A | * | 1/1978 | Mott | 405/226 |
| 4,318,641 | A | * | 3/1982 | Hogervorst | 405/224 |
| 4,423,559 | A | * | 1/1984 | Malin | 37/335 |
| 4,432,671 | A | * | 2/1984 | Westra et al. | 405/226 |
| 4,479,741 | A | * | 10/1984 | Berti et al. | 405/163 |
| 4,558,744 | A | * | 12/1985 | Gibb | 166/335 |
| 4,575,282 | A | * | 3/1986 | Pardue et al. | 405/228 |
| 4,674,915 | A | * | 6/1987 | Shatto, Jr. | 405/191 |
| 5,382,115 | A | * | 1/1995 | Jones et al. | 405/226 |
| 5,421,105 | A | * | 6/1995 | Schulte | 37/309 |
| 5,947,051 | A | | 9/1999 | Geiger | |
| 6,079,130 | A | * | 6/2000 | Freeman | 37/314 |
| 6,132,145 | A | * | 10/2000 | Treu et al. | 405/224 |
| 6,659,182 | B1 | * | 12/2003 | Saugier et al. | 166/358 |
| 6,719,496 | B1 | * | 4/2004 | Von Eberstein | 405/224 |
| 6,966,132 | B1 | * | 11/2005 | Jacobsen et al. | 37/195 |
| 2003/0121182 | A1 | * | 7/2003 | Jacobsen et al. | 37/195 |
| 2005/0229439 | A1 | * | 10/2005 | Nicholson et al. | 37/317 |
| 2006/0226058 | A1 | | 10/2006 | Porter | |

(Continued)

FOREIGN PATENT DOCUMENTS

| | | | | |
|---|---|---|---|---|
| JP | 55009928 | A | * | 1/1980 |

(Continued)

*Primary Examiner*—Thomas A Beach
(74) *Attorney, Agent, or Firm*—Duane Morris LLP

(57) ABSTRACT

This invention is directed to an underwater sediment evacuation system. The invention uses a suction pile and one or more pumps, valves, and lines to evacuate sediment contained within the internal volume of the suction pile.

20 Claims, 7 Drawing Sheets

U.S. PATENT DOCUMENTS

2008/0292409 A1 * 11/2008 Alhayari ..... 405/228

FOREIGN PATENT DOCUMENTS

JP 58149886 A * 9/1983
JP 61072132 A * 4/1986
JP 62160329 A * 7/1987
JP 03069727 A * 3/1991
WO WO 9218707 A2 * 10/1992

* cited by examiner

UNDERWATER SEDIMENT EVACUATION SYSTEM

BACKGROUND OF THE INVENTION

This invention is directed to an underwater sediment evacuation system. The invention uses a suction pile and one or more pumps, valves, and lines to evacuate sediment contained within the internal volume of the suction pile.

DESCRIPTION OF THE PREFERRED EMBODIMENTS

Figure 1:
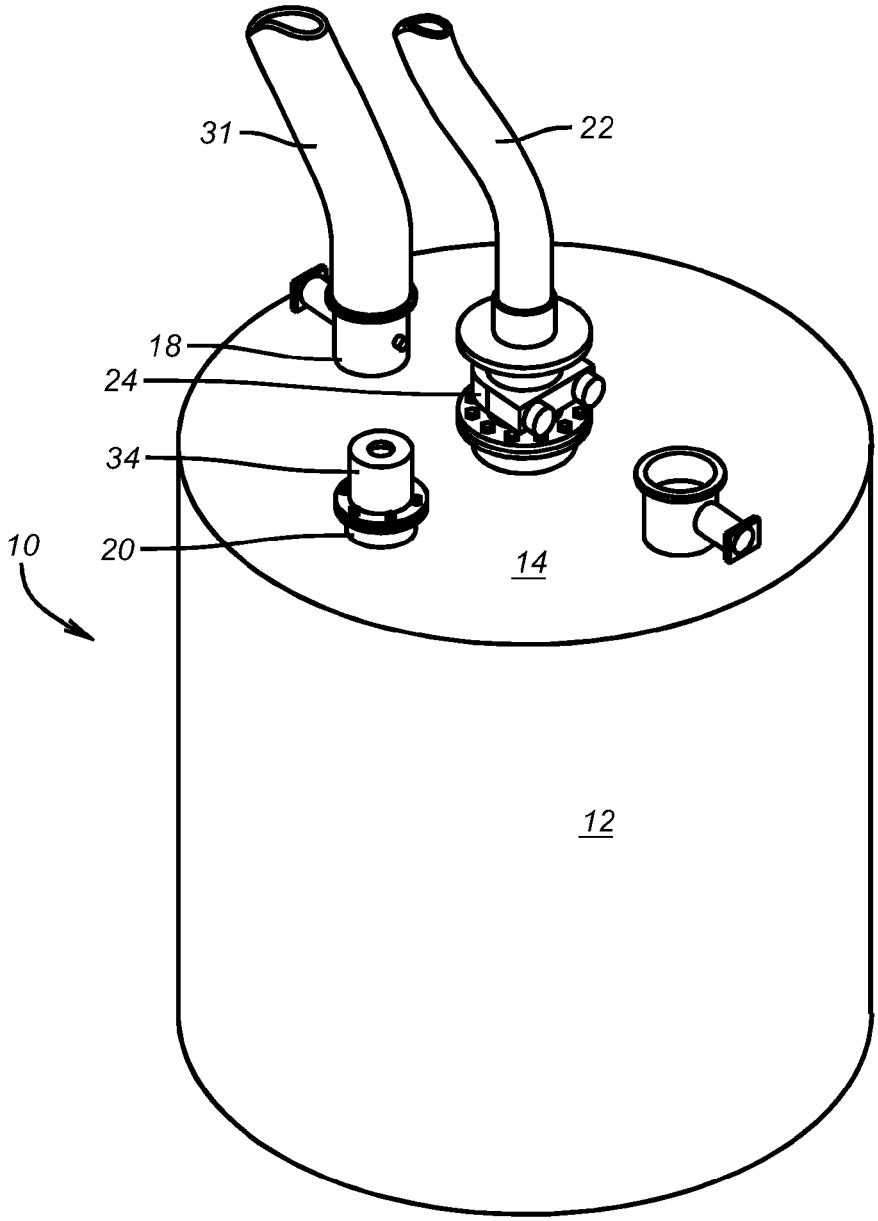
FIG. 1 is an outer isometric view of an embodiment of the invention.
Figure 2:
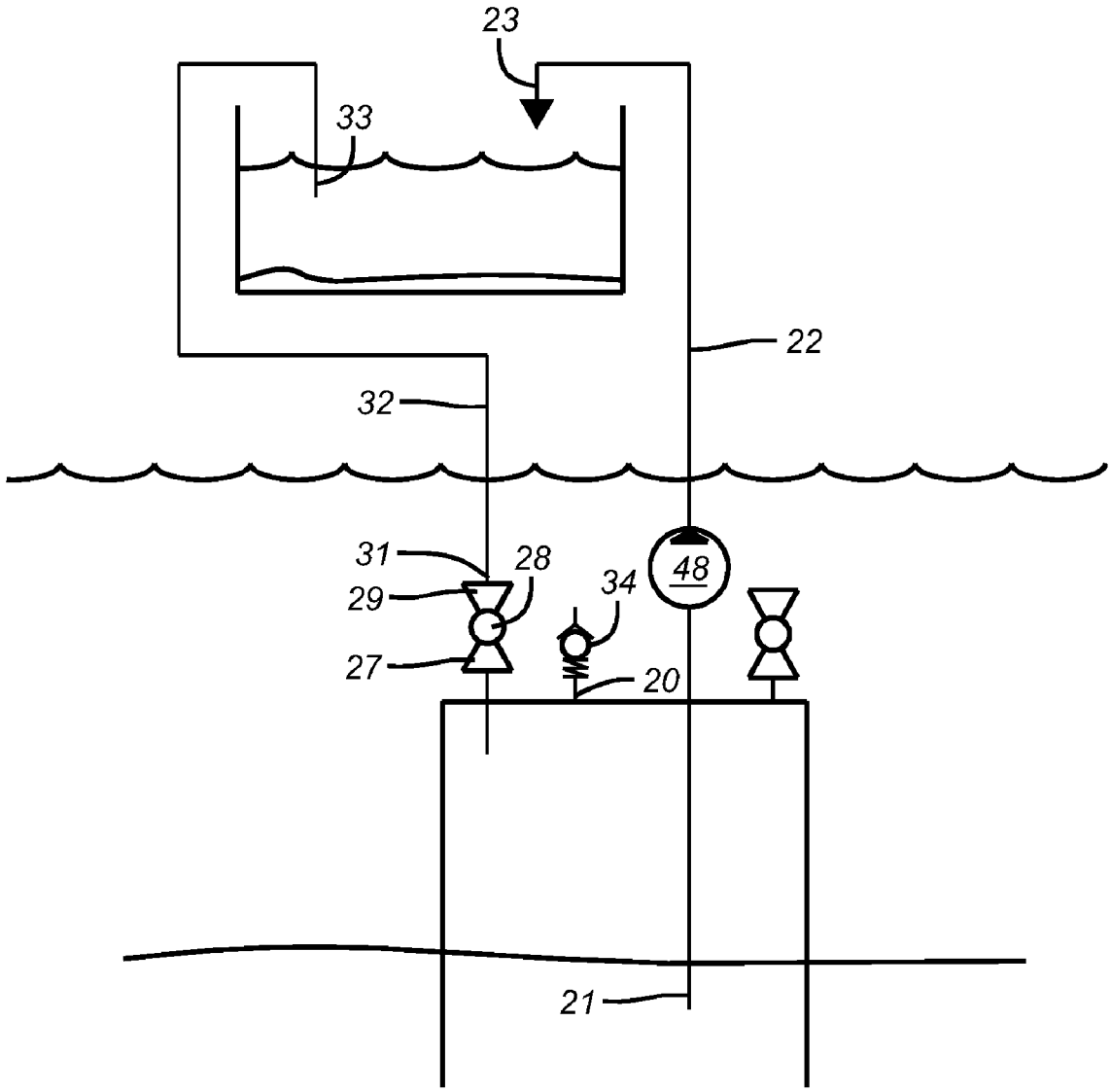
FIG. 2 is a side view of an embodiment of the invention.

A preferred embodiment of the invention is directed to an underwater sediment evacuation system. A first preferred embodiment comprises a housing 10, referred to herein as a "suction pile" comprising a substantially cylindrical body 12 and a top surface 14 comprising a suction port 16, an inlet port 18, and a differential pressure relief port 20, as shown in FIGS. 1-2. The body and top surface of the housing 10 define an internal volume.

This first embodiment further comprises a suction line 22 extending through the suction port and comprising a first end 21 in the internal volume, and a second end 23 opposite the first end, as shown in FIGS. 1-2 and 3A-3B.

Figure 3A:
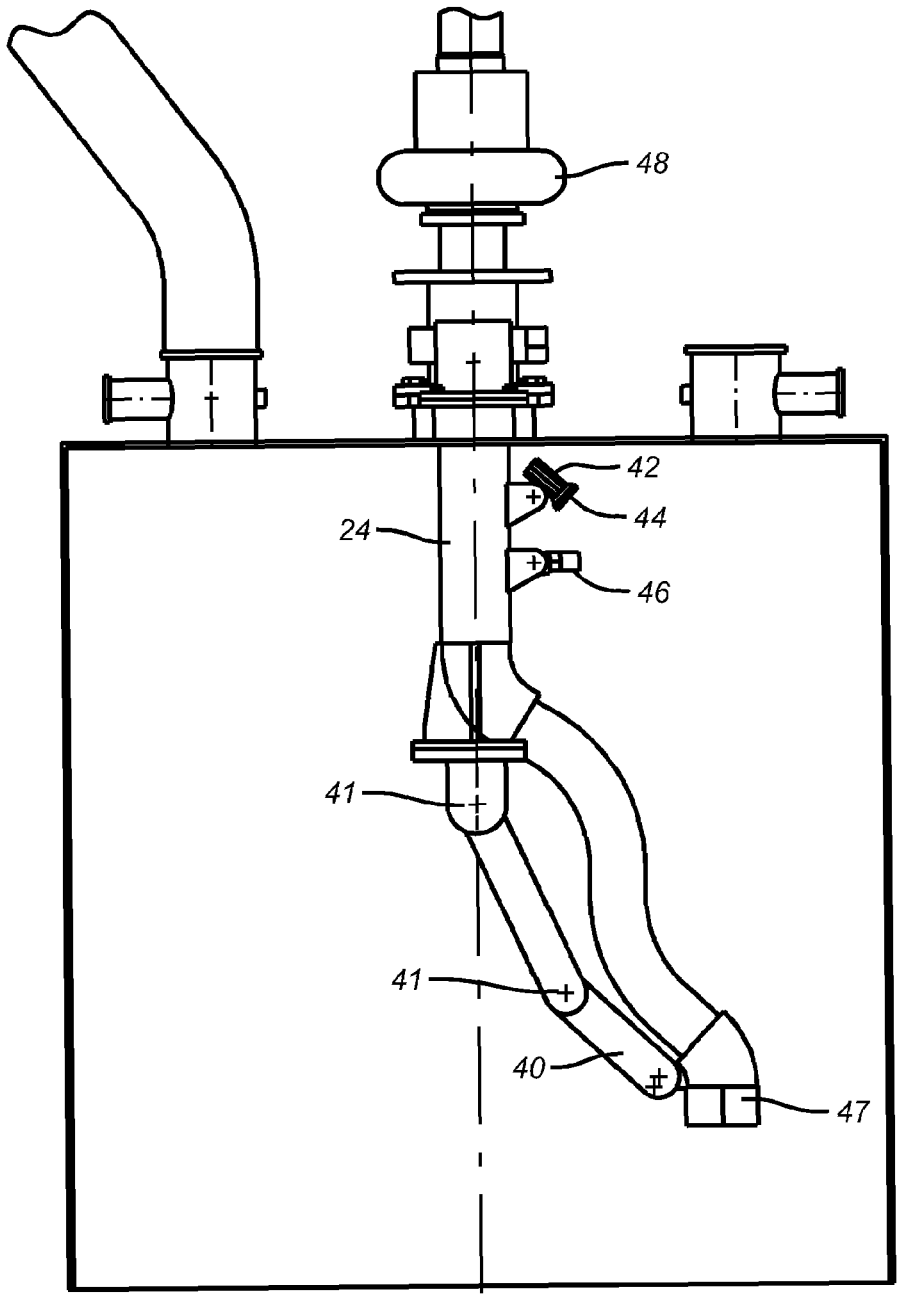
FIG. 3A is a first internal view of an embodiment of the invention.
Figure 3B:
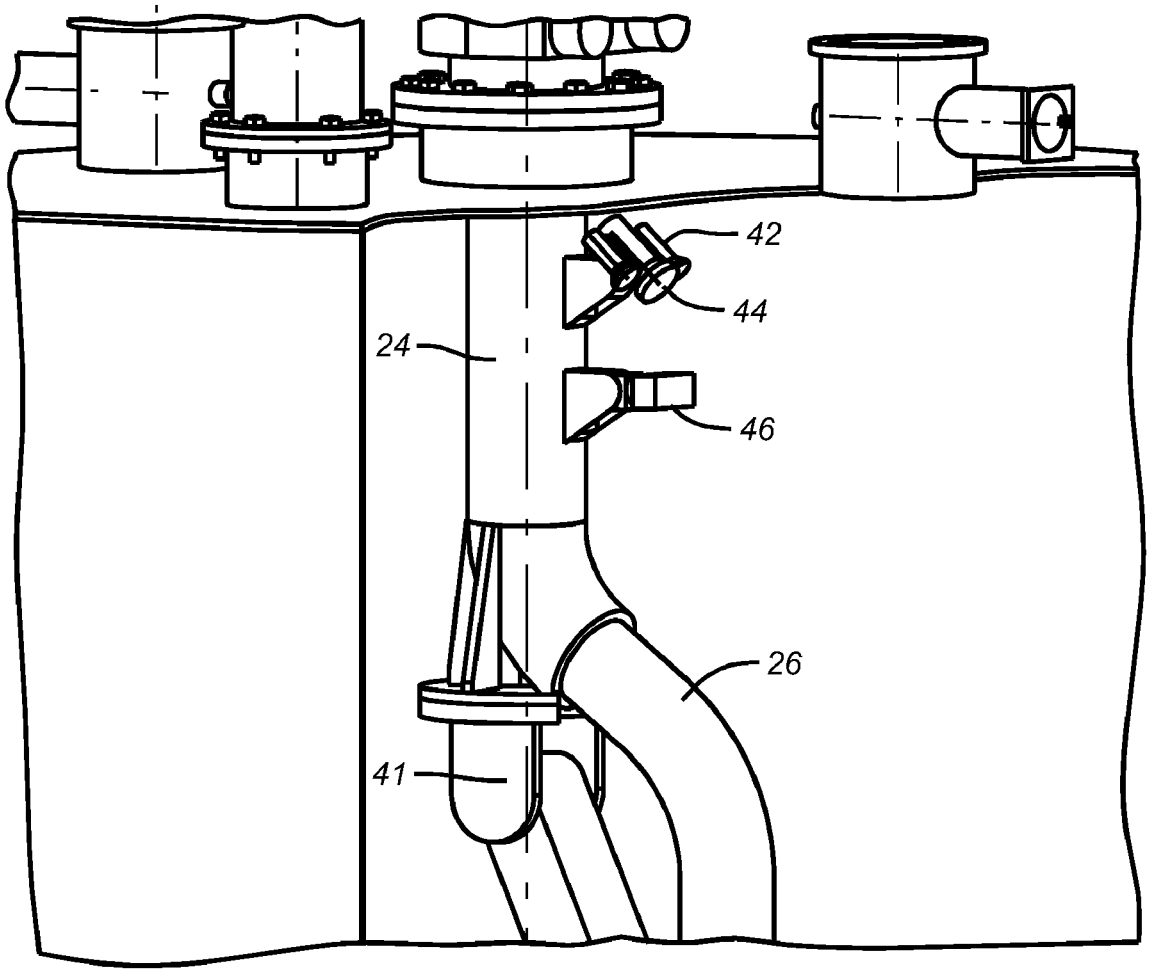
FIG. 3B is a partial internal view of an embodiment of the invention.

In another preferred embodiment the suction line comprises a standpipe section 24 extending through the suction port and a flexible section 26 extending downward from the standpipe into the internal volume and terminating at suction mouth 47, as shown in FIGS. 3A-3B. In a preferred embodiment, the standpipe is a rotary standpipe.

Figure 4:
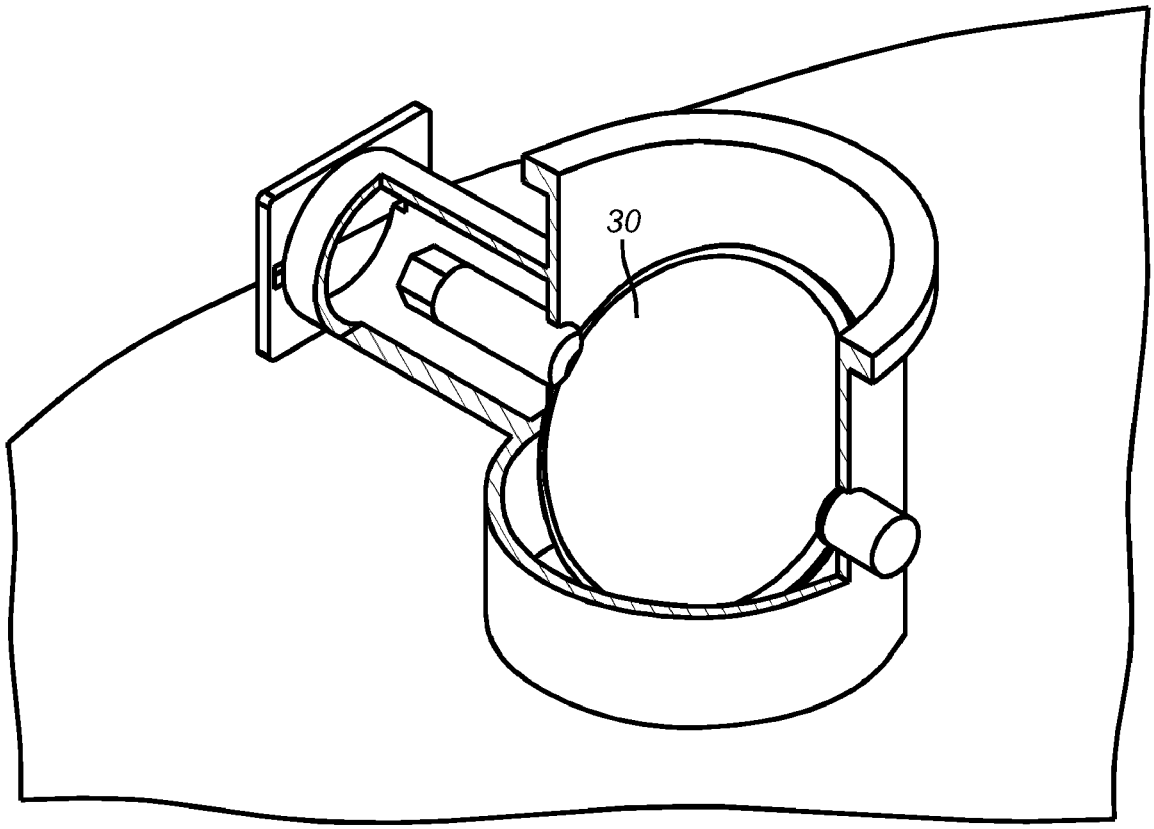
FIG. 4 is an internal view of an embodiment of a first valve suitable for use in an embodiment of the invention.

This first embodiment further comprises a first valve 28 comprising a discharge section 27 connected to the inlet port, an inlet section 29 opposite the discharge section, and a closure member 30 between the discharge and inlet sections, as shown in FIG. 2. The closure member may be a valve closure member well known in the mechanical arts, such as a gate, globe, or ball, as shown in FIG. 4.

This first embodiment further comprises a return line 32 comprising a first end 31 attached to the inlet section of the first valve and a second end 33 opposite the first end.

Figure 5A:
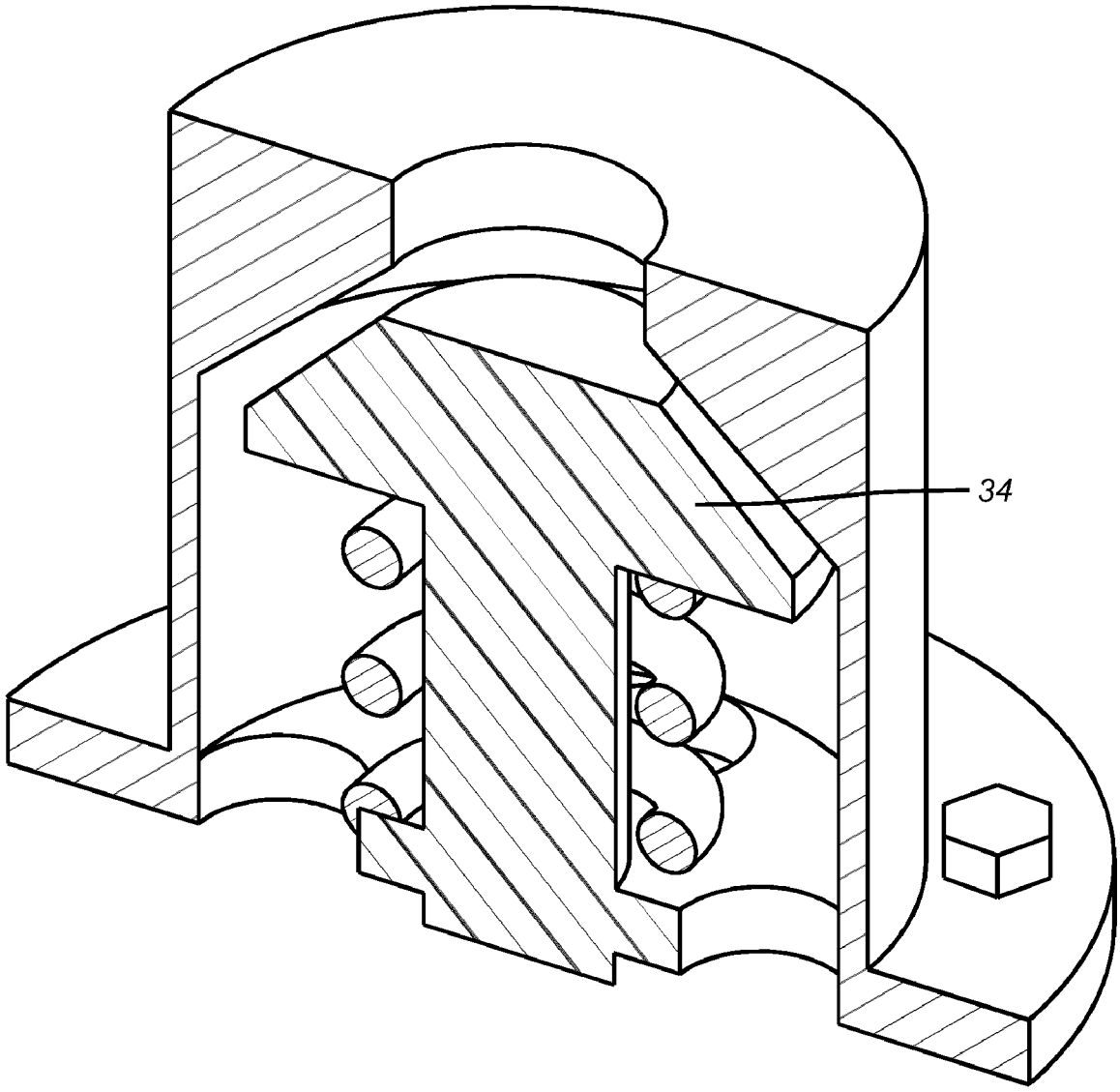
FIG. 5A is a cross sectional view of an embodiment of the relief valve mounted in the relief port.
Figure 5B:
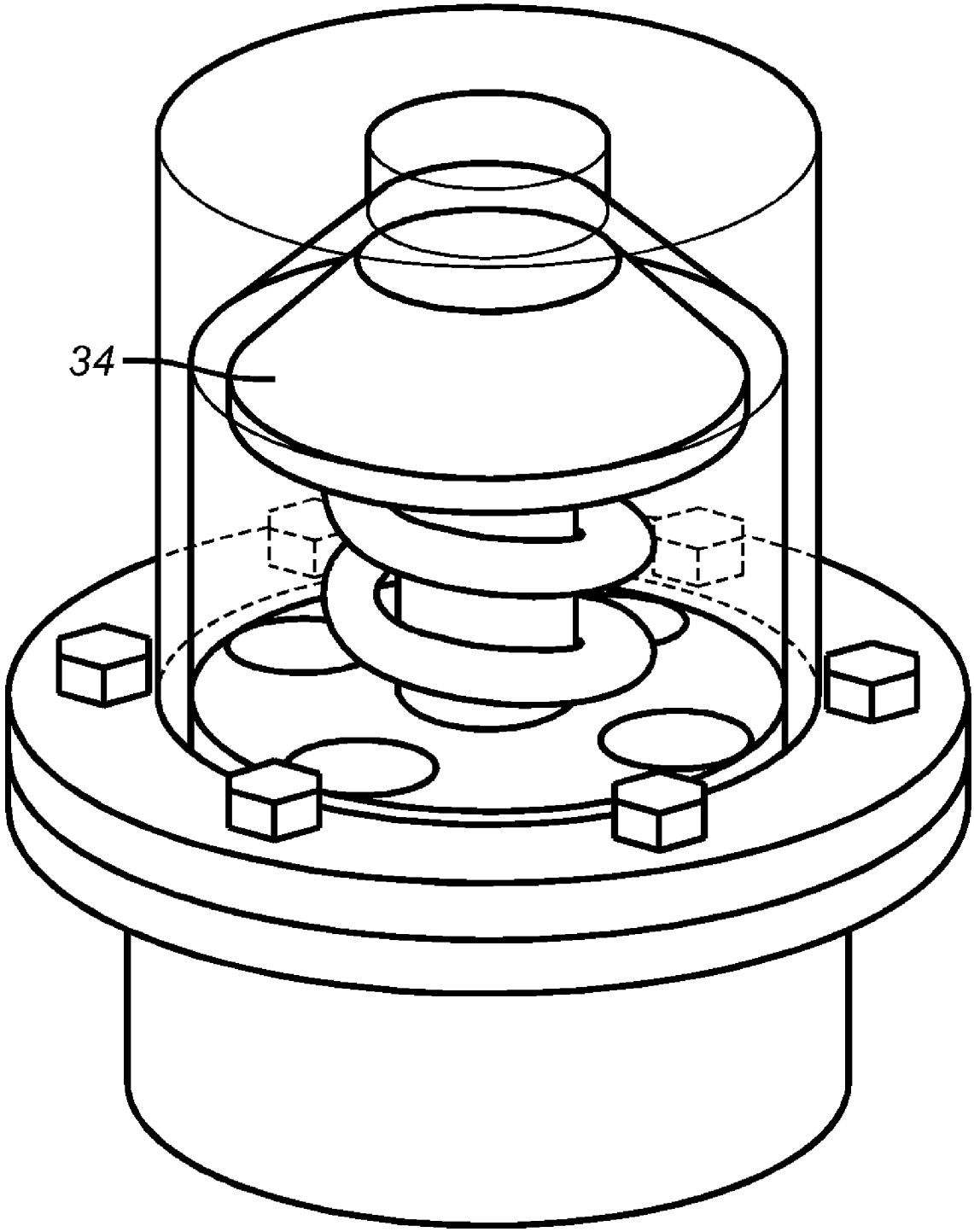
FIG. 5B is an internal view of an embodiment of the relief valve mounted in the relief port.

This first embodiment further comprises a relief valve 34 connected to the differential pressure relief port. In another preferred embodiment, the relief valve is a spring loaded valve, as shown in FIGS. 5A-5B.

In a second preferred embodiment, the invention comprises a housing or suction pile comprising a substantially cylindrical body and a top surface comprising a suction port, an inlet port, a control valve port, and a pressure relief port, as shown in FIGS. 1-2. The body and top surface of the suction pile define an internal volume.

This second embodiment further comprises the suction line, first valve, and return line, as described above for the first embodiment.

This second embodiment further comprises a relief valve connected to the pressure relief port, and a control valve connected to the control valve port.

In another preferred embodiment, the invention further comprises a robotic arm 40 attached to the portion of the standpipe in the internal volume and positioned such that it can grasp and move the flexible section of the suction line to a desired location. In a preferred embodiment, the robotic arm comprises at least two articulated joints 41, as shown in FIG. 3A. As shown in FIG. 3A, movement of sections of the robotic arm below either articulated joint can result in the robotic arm pushing against the suction line, causing it to move.

In another preferred embodiment, the invention further comprises a subsea light 42 mounted within the internal volume; and a subsea camera 44 mounted within the internal volume and positioned to provide real time images of the robotic arm and the flexible section of the suction line to a remote location, as shown in FIG. 3B. In a preferred embodiment, the light and camera are mounted to a rotatable joint to allow them to be aimed in a desired direction.

In another preferred embodiment, the invention further comprises a sonar unit 46 mounted within the internal volume and positioned to detect the location of the robotic arm and the flexible section of the suction line and configured to provide data indicative of said locations to a remote location, as shown in FIG. 3B. In a preferred embodiment, the sonar unit is mounted to a rotatable joint to allow it to be aimed in a desired direction.

In another preferred embodiment, the invention further comprises a suction pump 48 comprising a suction section connected to the second end of the suction line and a discharge section opposite the suction section, as shown in FIG. 2.

The foregoing disclosure and description of the inventions are illustrative and explanatory. Various changes in the size, shape, and materials, as well as in the details of the illustrative construction and/or an illustrative method may be made without departing from the spirit of the invention.

What is claimed is:

1. An underwater sediment evacuation system comprising:

a. a housing comprising a substantially cylindrical body and a top surface comprising a suction port, an inlet port, and a differential pressure relief port, said body and top surface defining an internal volume;

b. a suction line extending through the suction port and comprising a first end in the internal volume, and a second end opposite the first end;

c. a first valve comprising a discharge section connected to the inlet port, an inlet section opposite the discharge section, and a closure member between the discharge and inlet sections;

d. a return line comprising a first end attached to the inlet section of the first valve and a second end opposite the first end; and e. a relief valve connected to the differential pressure relief port.

2. The system of claim 1, wherein the suction line comprises a standpipe section extending through the suction port and a flexible section extending downward from the standpipe into the internal volume.

3. The system of claim 2, further comprising a robotic arm attached to the portion of the standpipe in the internal volume and positioned such that it can move the flexible section of the suction line to a desired location.

4. The system of claim 3, wherein the robotic arm comprises at least two articulated joints.

5. The system of claim 3, further comprising:

a. a subsea light mounted within the internal volume; and b. a subsea camera mounted within the internal volume and positioned to provide real time images of the robotic arm and the flexible section of the suction line to a remote location.

6. The system of claim 5, further comprising a sonar unit mounted within the internal volume and positioned to detect the location of the robotic arm and the flexible section of the suction line and configured to provide data indicative of said locations to a remote location.

7. The system of claim 5, wherein the subsea light and subsea camera are each mounted to a rotatable joint.

8. The system of claim 1, further comprising a suction pump comprising a suction section connected to the second end of the suction line and a discharge section opposite the suction section.

9. The system of claim 1, wherein the relief valve is a spring loaded valve.

10. An underwater sediment evacuation system comprising:

a. a housing comprising a substantially cylindrical body and a top surface comprising a suction port, an inlet port, a control valve port, and a pressure relief port, said body and top surface defining an internal volume;

b. a suction line extending through the suction port and comprising a first end in the internal volume, and a second end opposite the first end;

c. a first valve comprising a discharge section connected to the inlet port, an inlet section opposite the discharge section, and a closure member between the discharge and inlet sections;

d. a return line comprising a first end attached to the inlet section of the first valve and a second end opposite the first end;

e. a relief valve connected to the pressure relief port; and f. a control valve connected to the control valve port.

11. The system of claim 10, wherein the suction line comprises a standpipe section extending through the suction port and a flexible section extending downward from the standpipe into the internal volume.

12. The system of claim 11, further comprising a robotic arm attached to the portion of the standpipe in the internal volume and positioned such that it can move the flexible section of the suction line to a desired location.

13. The system of claim 12, wherein the robotic arm comprises at least two articulated joints.

14. The system of claim 12, further comprising:

a. a subsea light mounted within the internal volume; and b. a subsea camera mounted within the internal volume and positioned to provide real time images of the robotic arm and the flexible section of the suction line to a remote location.

15. The system of claim 14, further comprising a sonar unit mounted within the internal volume and positioned to detect the location of the robotic arm and the flexible section of the suction line and configured to provide data indicative of said locations to a remote location.

16. The system of claim 14, wherein the subsea light and subsea camera are each mounted to a rotatable joint.

17. The system of claim 10, further comprising a suction pump comprising a suction section connected to the second end of the suction line and a discharge section opposite the suction section.

18. The system of claim 10, wherein the relief valve is a spring loaded valve.

19. An underwater sediment evacuation system comprising:

a. a housing comprising a substantially cylindrical body and a top surface comprising a suction port, an inlet port, a control valve port, and a pressure relief port, said body and top surface defining an internal volume;

b. a suction line extending through the suction port and comprising a first end in the internal volume, a second end opposite the first end, a rotary standpipe section extending through the suction port and a flexible section extending downward from the standpipe into the internal volume;

c. a first valve comprising a discharge section connected to the inlet port, an inlet section opposite the discharge section, and a closure member between the discharge and inlet sections;

d. a return line comprising a first end attached to the inlet section of the first valve and a second end opposite the first end;

e. a relief valve connected to the pressure relief port;

f. a control valve connected to the control valve port; and g. a robotic arm attached to the portion of the standpipe in the internal volume and positioned such that it can move the flexible section of the suction line to a desired location.

20. The system of claim 19, further comprising a suction pump comprising a suction section connected to the second end of the suction line and a discharge section opposite the suction section.

* * * * *